United States Patent [19]

Kessler

[11] 4,023,217

[45] May 17, 1977

[54] SWIMMING POOL CONSTRUCTION

[76] Inventor: Frank Lee Kessler, 17 Vassar Road, Broomall, Pa. 19008

[22] Filed: Nov. 25, 1974

[21] Appl. No.: 526,935

[52] U.S. Cl. ..... 4/172.19

[51] Int. Cl.[2] ..... E04H 3/16; E04H 3/18; F16L 22/02

[58] Field of Search ..... 4/172.19, 172, 196, 4/172.21, 172.18; 52/489, 169, 357

[56] References Cited

UNITED STATES PATENTS

| | | | |
|---|---|---|---|
| 3,347,006 | 10/1967 | Fox | 4/172.21 |
| 3,416,165 | 12/1968 | Pereira | 4/172.19 |
| 3,444,659 | 5/1969 | Shanni | 4/172.19 X |
| 3,555,575 | 1/1971 | Schwartz et al. | 4/172.19 |
| 3,654,640 | 4/1972 | Katzman | 4/172.19 |
| R26,977 | 11/1970 | Pereira | 4/172.19 |

*Primary Examiner*—Henry K. Artis
*Attorney, Agent, or Firm*—Jay M. Cantor

[57] ABSTRACT

The disclosure relates to the features of construction of a rectangular swimming pool having an aluminum framework comprised of upper and lower rails, uprights connecting the rails and a sheet metal or plastic wall between the rails enclosing the pool area. A vinyl liner provided with a bead about its perimeter covers the sides and bottom of the pool with the bead inserted in a channeled member attached to the upper rail to overlie the upper marginal edge portion of the pool wall. The corner upright of the framework is a reinforced angled post to which is attached a curved surface with the concavity facing inwardly and having reverse curves to overlie bolts which secure the wall to the sides of the angled posts.

5 Claims, 7 Drawing Figures

Fig. 1
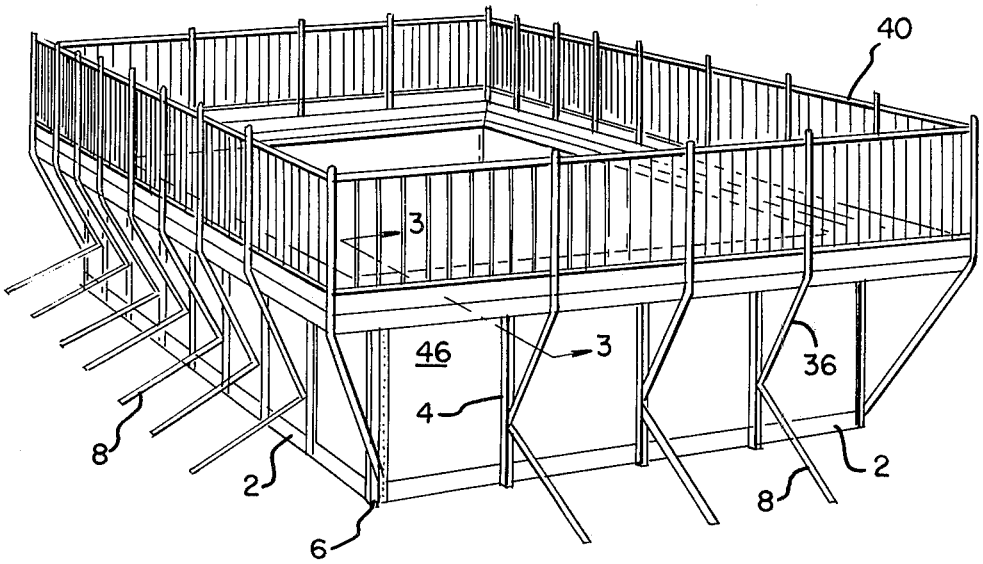
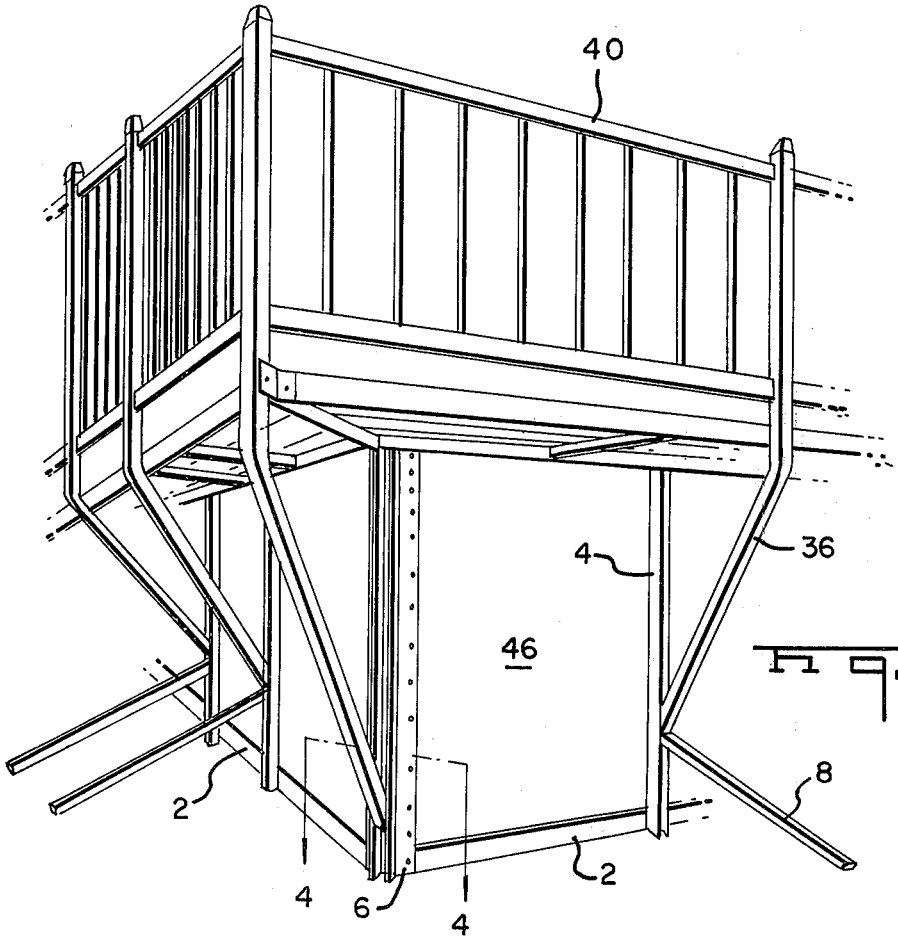
Fig. 2

SWIMMING POOL CONSTRUCTION

The herein disclosed invention relates to an above ground swimming pool construction, especially a swimming pool of substantially rectangular shape.

In the prior art, swimming pools are constructed above ground by providing a channeled bottom rail outlining the pool area, securing uprights to the bottom rail and then inserting the sheet metal or plastic wall into the bottom rail and against the uprights. A water retaining liner of vinyl is then draped about the top edge of the wall and secured by a channeled member which is in the nature of a clip and which fits over the top edge of the all to secure the marginal edge portion of the liner to the wall. To protect the clip and rigidify the wall, a top rail is placed thereover and secured to the uprights. If a deck for the pool is desired, a coping is placed over the rail and supported in some suitable manner by the uprights. If it becomes necessary to remove the liner because of wear or damage thereto, it is obvious that the coping, the rail and the clip must first be removed in order to remove the liner. Even in the absence of a deck, just the removal and replacement of the clip and rail members are time and energy consuming. It should be noted from the above construction, that if after the wall is set into the bottom rail and before its upper edge is adequately secured, it is subject to being damaged by high winds.

In order to obviate the above disadvantages in the construction of swimming pools and more particularly rectangular swimming pools, it is contemplated that the swimming pool of this invention be so constructed that the framework of the pool, including the top and bottom rails, the uprights, a deck or porch and fencing if so desired, be completely assembled above ground as a self-contained unit before the sheet metal or plastic pool-enclosing wall is installed in place and secured. In this way, should high winds occur before or after completion of the struction prior to installation of the wall, no damage is likely to be incurred. The wall is then inserted in the bottom rail and its upper portion retained adjacent the upper rail by a retainer member attached to and coextensive with the upper rail and which overlies the upper end of the wall. The retainer member is provided with a channel portion facing upwardly for the reception of the beaded edge of the vinyl water-retaining liner in the manner disclosed in my copending application Ser. No. 418,917, filed Nov. 26, 1973. With this construction, it is obvious that the liner can be removed without dismantling any portion of the pool structure. Furthermore, the downward force of the water on the liner and bead is not transferred to upper edge of the pool-enclosing wall, as in the prior art, but to the uprights which are secured to and support the upper rail.

As a further feature of the rectangular swimming pool construction of this invention, the corner uprights which extend between the top and bottom rails are each formed L-shaped in cross-section with its outer corner secured to, or integral with, the outer surface of the bottom wall of a channel-shaped member which receives a brace or buttress. Since the side and end walls of the pool enclosure are secured to the sides of the angular post, the tendency of the angle of the post to spread and eventually to cause the post to give way due to the pressure of the water against the attached walls, is avoided by the reinforcement provided by the attachment of the channel-shaped member to its outer corner. Due to the tendency of water to swirl and form in a circle, the vinyl liner will have a tendency to pull away from the corners of the pool leaving a space between it and the wall. With no rigid backing for the liner at those locatins, there is great danger of tears or punctures by persons in the vicinity. It is therefore good practice to place a curved wall in the corner of the pool, with its concave surface facing inwardly to form a rigid backing surface for the vinyl liner. In the present invention, this wall is provided with reversely curved side extensions to cover the bolt heads or nuts by which the pool walls are secured to the sides of the angled posts.

It is therefore an object of this invention to provide a swimming pool wherein the vinyl liner is secured to the framework of the pool and not to the enclosing wall.

It is another object of this invention to so detachably secure the vinyl liner of a swimming pool to the framework thereof, that it is readily detached without disturbing any portion of the pool structure.

It is a further object of the invention to provide a rectangular swimming pool having corner posts of L-shaped section to the sides of which the walls of the pool are secured and which are reinforced to avoid spreading of the post angle by the water pressure against the walls attached thereto.

It is still an additional object of the invention to provide a rigid curved backing wall for the liner in the corners of a rectangular swimming pool.

With the above and further objects which may become apparent, the description of the invention proceeds with specific reference to the drawings in which:

FIG. 1 is a perspective view of the pool assembled above ground and showing a deck and a fence about the perimeter thereof;

FIG. 2 is a perspective view of an outside corner of the pool showing details of construction of the framework thereof;

FIG. 3 is a cross-sectional view along line 3—3 of FIG. 1;

Figure 5:
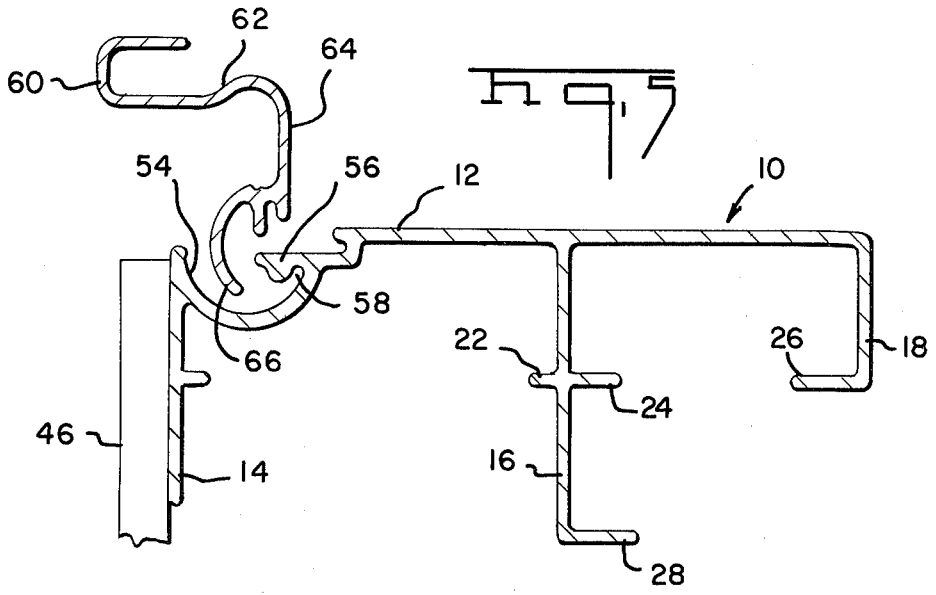
Figure 6:
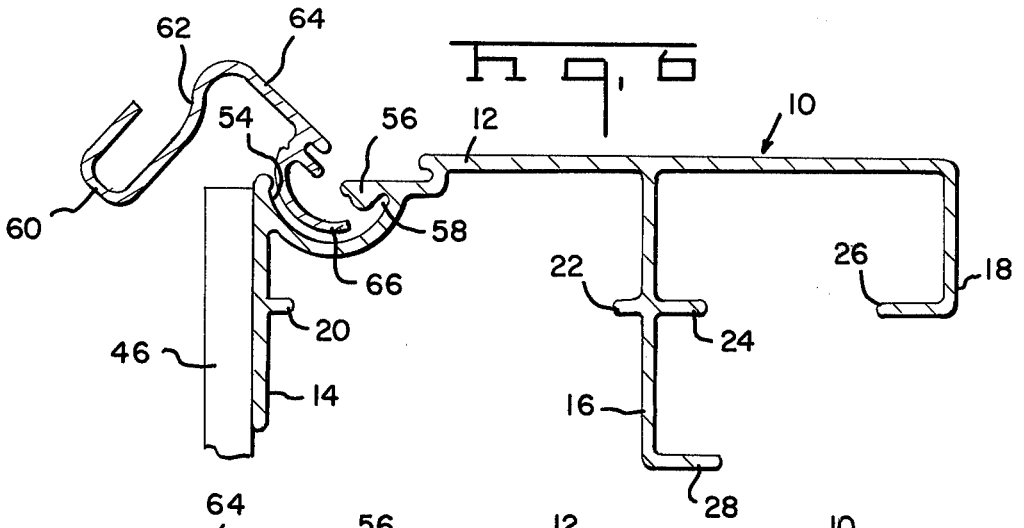
Figure 7:
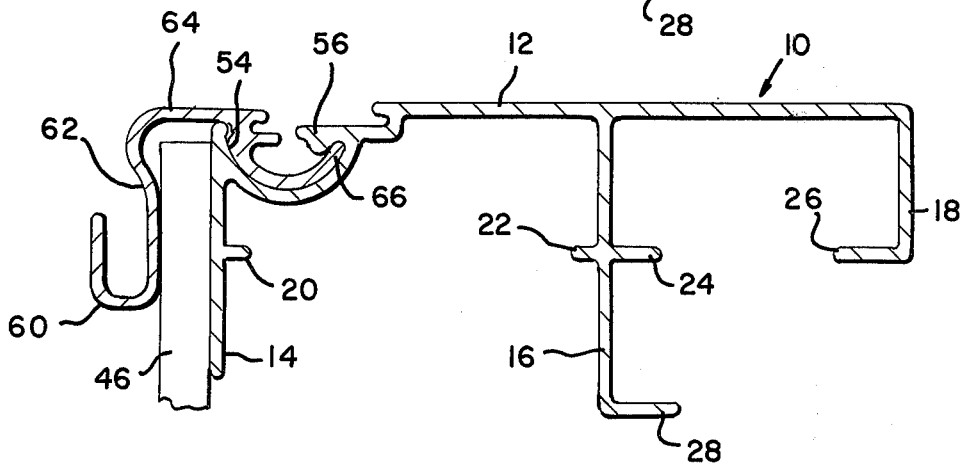

As shown in FIGS. 1 and 2, the pool is generally rectangular in form and is provided with a bottom rail 2 comprised of four sections which outline the area of the pool. Uprights 4, which are laterally equally spaced, and including corner uprights 6, are secured to the bottom rail exteriorly of the pool areas in any known conventional manner. Buttresses 8 are secured at one end of the uprights exteriorly thereof and anchored at their other ends in the ground in any known manner. The uprights 4 may be of hollow rectangular form or of other desired shape. As so far described, the parts and their assembly are conventional and form no part of this invention. A coping is provided by several separate sections, one of which, hereinafter designated as top rail 10, is so constructed as to seat on the upper ends of the uprights. Each of the top rail sections 10 as seen in cross-section in FIG. 5 comprises an elongated metal extrusion, preferably of aluminum, having a top wall 12 and three laterally spaced parallel depending walls 14, 16 and 18 extending transversely from the top wall along the entire length of the rail. The walls 14 and 16 are respectively provided with a pair of alined ledges 20 and 22 projecting toward each other which seat on the upper edge of an upright which is received between the walls, as shown in FIG. 3.

The depending wall 16 is provided with a second ledge 24 which projects oppositely to ledge 22 and is alined with an inturned lower end portion 26 of wall 18. Spaced below ledge 24 is the inturned end 28 of depending wall 16 extending parallel thereto. As shown in FIG. 3, one end of a joist 30 is seated on the ledge 28, the other end being supported on a ledge 32 provided on a rear coping 34 which is secured to a fence post 36 extending vertically upward from its point of securement to the coping 34 and extending downwardly at an angle, to substantially the midpoint of an upright 4 to which its end is secured. The length of the joist 30 determines the width of a deck or walkway for the swimming pool since it determines the width of a flooring member 38 supported thereon between the rail 10 and coping 34. A fence 40 for the deck, may be secured to the vertically extending portion of the post 36.

Figure 4:
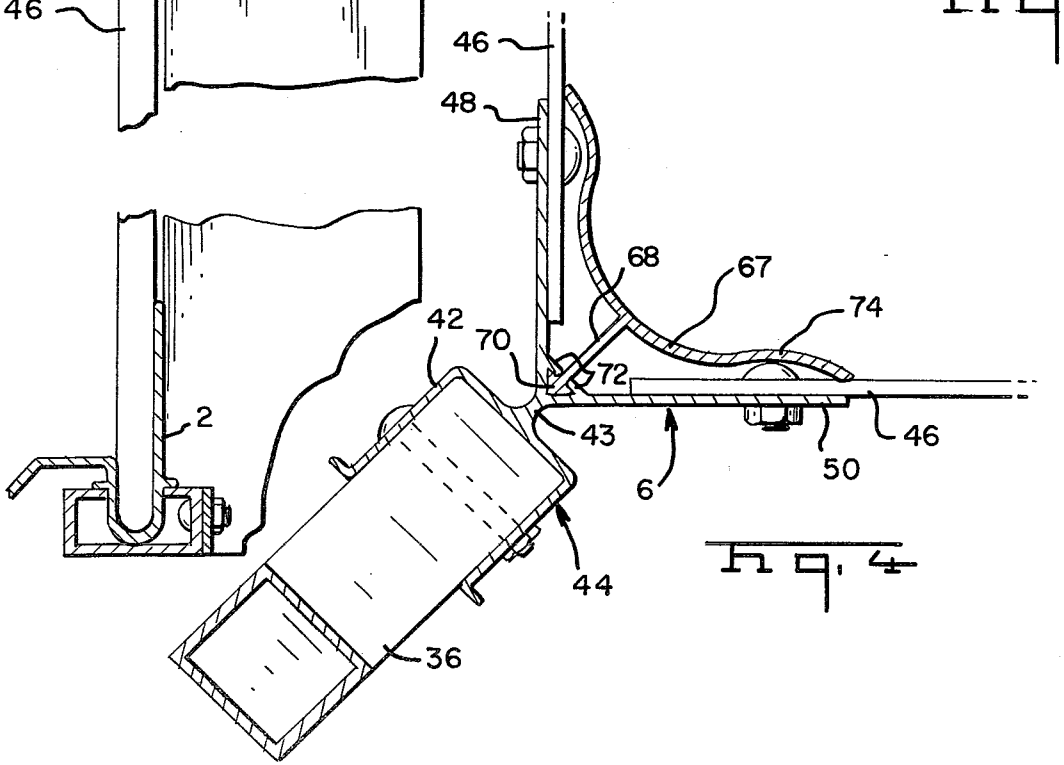
FIG. 4 is an enlarged cross-section view along line 4—4 of FIG. 2.

The corner posts 6 of the swimming pool are of different form than the other of the uprights or posts, and are each constructed as a post which is L-shaped in cross-section, as seen in FIG. 4. Secured to or integral with the outer corner of post 6, is web 43 connecting the outer surface of the bottom wall 42 of a channel-shaped member 44 which is substantially coextensive with the post. The web 43 forms a wall extending from the outer corner of the post along a line which bisects the angle of the post 6. The lower end portion of the corner fence post 36 is secured to the corner post 6 within the channel of the member 44, the included angle of the post facing the pool when the post is secured to the top and bottom walls. With the enclosing sheet walls of the pool being secured to the sides of the corner post as later described, it will be apparent that the pressure of the water against the walls would normally tend to spread the sides of the post about the apex of its included angle to flatten the post and to thus cause it to give way by bending or buckling. However, with the channel member 44 and web portion 43 reinforcing the post 6, the latter is prevented from buckling by the pressure of the water.

The pool is enclosed by a wall comprised of four sheets 46 of metal or plastic, one for each side of the pool, each of the sheets being one piece or several pieces secured together. The sheets are inserted in the bottom rail 2 which is grooved to receive the bottom edge thereof and secured at their ends to the sides 48 and 50 of the corner posts, as by bolts. The upper end of the wall 46 bears against the inner surface of the wall 14 of the upper rail 10 and is maintained thereagainst by a retaining member 52 which can be attached to the upper rail 10 and which extends therealong and overlies the upper end of the wall 46. The means, by which such retaining member is attached to the rail, may take any one of a number of forms, one of which will now be described. As can be seen from the drawings, the upper surface 12 of the upper rail 10 is formed with a depression extending along an edge thereof which is adjacent the wall 14 of the rail. The depression forms a channel 54 which is a sector of a circle in cross-section. Projecting from the end of the wall of the depression farthest from wall 14, is a ledge 56 which extends partially across the mouth of the channel 54. The bottom surface of the ledge 56 is spaced from and parallel with the channel wall to form a curved slot 58 opening into the channel.

Figure 7:
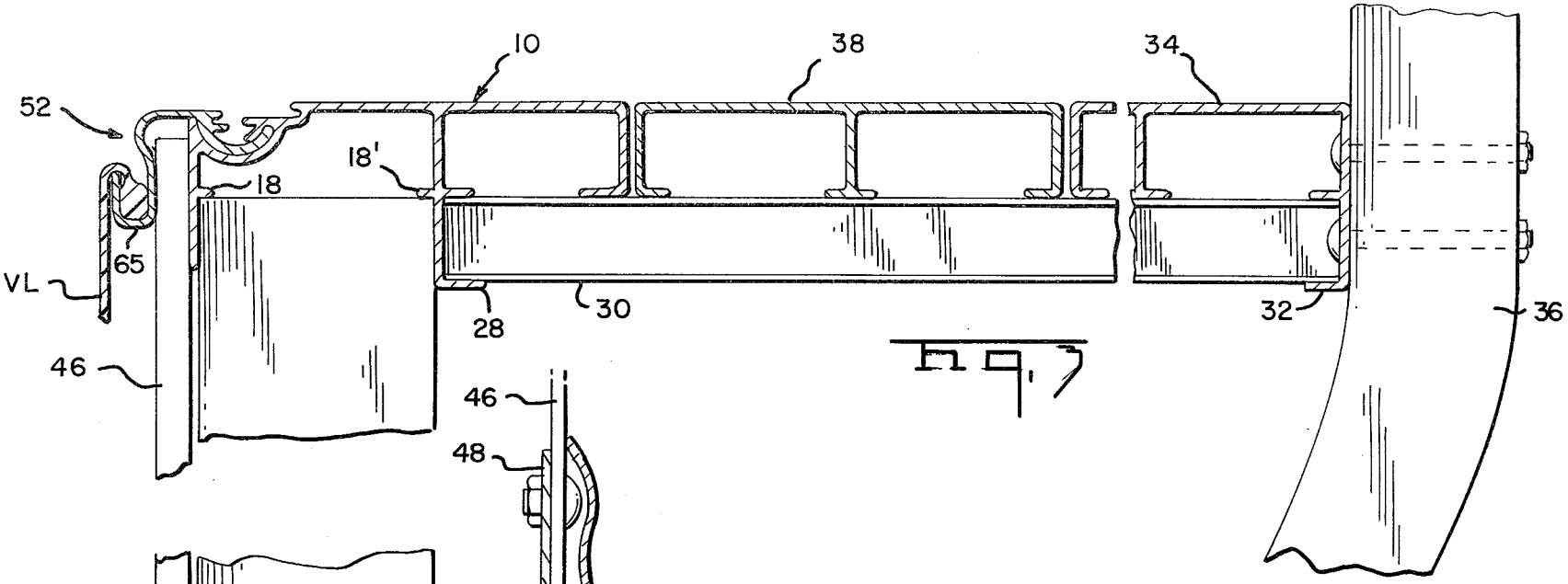
FIG. 5, 6 and 7 are cross-sectional view of the top rail similar to that shown in FIG. 3, with various positions of the bead receiver as it is being locked into position on the rail.

The retainer 52 is provided at one end with a portion which is U-shaped in cross-section. One side 62 of the U-shaped section is much larger than the other, is bent to form a laterally extending portion 64 and is provided with a curved termination 66 which has a dimension and a curvature to fit within the channel 54 of the retainer member 52. As can be observed in FIG. 7, when the curved portion 66 of the retainer member lies against the bottom of channel 54 with its edge against the bottom of the slot, the retainer is locked against downward and lateral movements with the lateral portion overlying the upper edge of the wall 46. The portion 64, which is U-shaped in cross-section, extends along the upper portion of the wall 46 with an open channel facing upwardly. It can be seen from the above construction, that after the framework of the pool is assembled, including the top and bottom rails and the uprights, the sheet wall sections 46 are mounted in the bottom rail to enclose the pool area and the retainer then attached to the upper rail to maintain the wall against its inner surface and to prevent it from buckling inwardly due to high winds, especially when there is little or no water in the pool.

Additionally, the portion 64 of the retainer forms a receiver for the edge bead 65 of a vinyl water-retaining liner VL for the pool as disclosed in the above-mentioned earlier filed application. The liner, after installation, normally lies against the pool wall by the water pressure exerted thereagainst. However, since water has the tendency to swirl in the form a circle, the liner would be pulled away from the corners of the rectangular pool and would thus be spaced from the pool walls. Without a rigid backing therefor, the vinyl liner is subject to being punctured by persons moving about in the vicinity. Accordingly, there is provided a vertically extending curved rigid sheet 67 having a wall 68 projecting from the center of its rear convex surface. The free end of wall 68 terminates in a triangular bead 70 which fits into the inner corner of the post 6 and is retained in such corner by a pair of opposed projections 72 from the respective walls 48, 50 of the corner post, as seen in FIG. 4. The concave surface of the sheet 67 faces inwardly and forms a backing for the corner portion of the liner. The end portions of the curved sheet are reversely curved as at 74 where they overlie the bolts which secure the enclosing wall of the pool to the sides of the corner post and form a smoother-walled cover thereover. The protective curved sheet 67 extends upwardly from the bottom of the pool to a point just below the retainer 52 so that it does not interfere with the latter when it is attached to the top rail in the manner described above.

As can be seen from the above description, the parts of the swimming pool are so designed and constructed that the framework thereof provided by upper rail, the lower rail, the uprights extending between these rails, a deck or walkway including a fence therefrom, can all be assembled to form the outline of the pool before installation of the walls which enclose the pool area. The pool wall can be installed last and ensured against the possibility of buckling inwardly by the retainer member attached to the upper railing and overlying the upper end of the wall, the retainer also comprising the receiver for the edge bead of the vinyl liner for supporting it about its periphery.

Further modifications will obviously suggest themselves to those skilled in the art and various other ways of attaching the combination bead receiver and pool-wall retainer may obviously be employed to practice the underlying concept of this invention without departing from the spirit and scope thereof as defined by the appended claims.

Having thus described the invention with the particularities required by the statutes what is claimed is:

1. A rectangular swimming pool comprised of side and end top and bottom rails with laterally spaced uprights extending between the top and bottom rails and including corner uprights, rigid pool-enclosing wall means extending between the top and bottom rails, said corner uprights each comprising a post substantially L-shaped in cross section with the included angle facing inwardly, bolts securing the outer surface of said wall means to the inner sides of the post, and a vertically extending rigid wall section having an inwardly facing concave surface lying athwart the included angle provided by each post and secured to the inner corner thereof, the wall section having side extensions which overlie the bolts and an upright channeled bar coextensive with the post with the outer surface of its bottom wall secured to the outer corner of the post.

2. A rectangular swimming pool according to claim 1 wherein said side extensions are reversely curved relative to the concave surface.

3. A swimming pool construction comprised of top and bottom rails forming enclosed figures with laterally spaced uprights extending between and secured to the top and bottom rails to provide a free-standing structural framework, rigid pool enclosing wall means supported at its lower end by said bottom rail with its upper marginal end portion lying against an outer side surface of the upper rail, and a gutter for overflow of water from the pool, comprising a depressed channel-shaped portion in the top rail along its marginal edge portion adjacent the pool, an inverted substantially L-shaped strip, the horizontal leg of said strip having a portion provided with a depressed channel portion nesting within the channel-shaped portion of the top rails and a portion overlying the upper edge of the wall means, the vertical leg of said strip extending along the upper portion of the wall means and having its bottom edge upturned to form an upwardly open channel to receive the beaded edge of a water-retaining pool line.

4. A swimming pool according to claim 3 wherein said upper rail is provided with locking means cooperating with said strip for retaining the channel-shaped portions in nested relation.

5. A swimming pool according to claim 4 wherein said locking means comprises an element secured to the top rail overlying the free end of the horizontal leg.

* * * * *